United States Patent [19]

Bayless

[11] 4,265,454

[45] May 5, 1981

[54] DISC SHAPED PROJECTILE HAVING NOTCHED PORTION

[76] Inventor: Mark S. Bayless, Rte. 2, Napoleon, Ohio 43545

[21] Appl. No.: 53,697

[22] Filed: Jun. 29, 1979

[51] Int. Cl.[3] ..... A63B 65/10; A63H 27/00

[52] U.S. Cl. ..... 273/427; 46/74 D; D21/4

[58] Field of Search ..... 46/74 D; 273/336, 424, 273/426, 427, 428; D21/86, 92, 4

[56] References Cited

U.S. PATENT DOCUMENTS

| | | | |
|---|---|---|---|
| D. 96,476 | 8/1935 | Isaacs | D21/4 |
| D. 209,526 | 12/1967 | Dunbar | D21/92 |
| 2,265,517 | 12/1941 | Clement | 273/336 |
| 3,359,678 | 12/1967 | Headrick | 46/74 D |
| 3,959,915 | 6/1976 | Kettlestrings | 273/424 X |

FOREIGN PATENT DOCUMENTS

| | | | |
|---|---|---|---|
| 1420 | of 1892 | United Kingdom | 273/427 |

*Primary Examiner*—Harland S. Skogquist

*Attorney, Agent, or Firm*—Wilson, Fraser, Barker & Clemens

[57] ABSTRACT

Disclosed is a game including a projectile generally saucer-shaped with a portion cut out, defining a main body portion and two leg portions. The projectile may easily be adapted for grasping by the extension of the legs into a flattened circular area which may be defined by a raised ring to prevent slippage of the grasping fingers. The projectile is designed for use in the game wherein the projectile is directed and thrust towards a scoring stake which functions as a target for the projectile. The objective of the game is quite similar to horseshoes, in attempting to ring the stake with the projectile.

6 Claims, 4 Drawing Figures

DISC SHAPED PROJECTILE HAVING NOTCHED PORTION

BACKGROUND OF THE INVENTION

This invention relates to a game including an aerial projectile which is employed in a manner similar to horseshoes or quoits. The object of these games as is the object of the present invention is to encircle or ring a stabilized stake to produce a score.

In the past, these games have employed a flattened circular or flattened U-shaped projectile. Generally, the projectile is constructed of a heavy material with poor aerodynamic characterisitics. The projectile's weight necessitates some degree of strength and skill in order to throw the missile such that a score is achieved.

It is an object of this invention to produce a game including an aerial projectile of a saucer shape adapted to ring a stake when thrown at the stake by a player.

Another object of this invention is to provide an aerial projectile that requires less thrust and considerable skill to encircle or ring a target stake.

A further object of this invention is to provide an aerial projectile adapted for ease of grasping and projecting.

BRIEF DESCRIPTION OF THE DRAWINGS

Other objects and advantages of the invention may be achieved by a game including a saucer shaped projectile having a portion cut out to define a main body portion and two spaced apart leg portions, and a scoring stake as a target for the projectile.

The above as well as other objects of the invention will become readily apparent to one skilled in the art from reading the following detailed description of a preferred embodiment thereof when considered in the light of the accompanying drawings, in which.

DESCRIPTION OF THE PREFERRED EMBODIMENT

Figure 1:
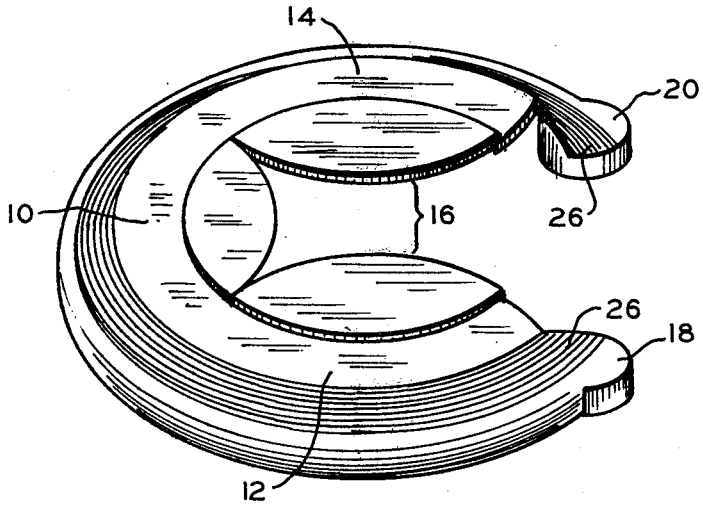
FIG. 1 is a perspective view of an aerial toy projectile embodying the features of the invention illustrating the saucer shape cut out to define a main body portion and two spaced apart leg portions.
Figure 3:
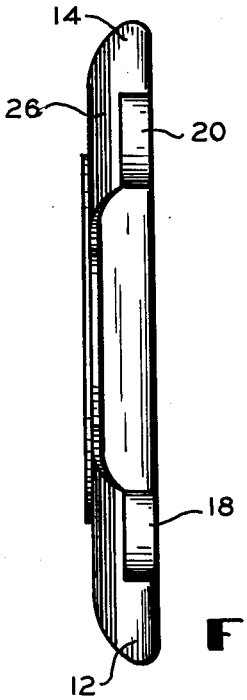
FIG. 3 is a side elevational view of the projectile illustrated in FIG. 1.
Figure 4:
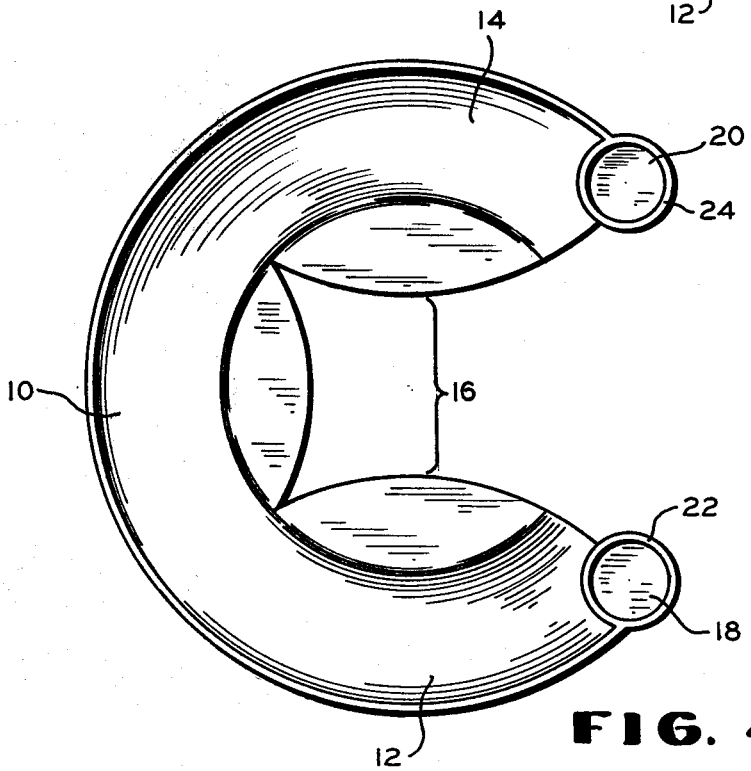
FIG. 4 is a bottom plan view of the projectile illustrated in FIGS. 1 and 3.

The game of the present invention includes an aerial projectile which is easy to manipulate and can be used by adults or children with equal facility. In carrying out the present invention, the aerial toy as depicted in FIGS. 1, 3 and 4, is generally saucer shaped. The projectile has a general surface of curvature forming a convex upper surface and concave lower surface. The projectile has a main body portion 10 and two spaced apart leg portions 12 and 14 which are defined by a cut-out portion 16.

The leg portions 12 and 14 each terminate in grasping areas 18 and 20, respectively. The grasping areas 18 and 20 comprise a flattened semi-circular area extending beyond the tips of the leg portions. The underside of the grasping areas 18 and 20 is bounded by upstanding ridges 22 and 24, respectively, which produce means for preventing slippage, as is clearly depicted in FIG. 4. The raised ridges 22 and 24 along the boundary of the grasping means insures that the player will grip the projectile without allowing any slippage of the grasp.

A series of concentric raised rings 26 proximate the outer rim on the convex side of the projectile may be employed to improve the aerodynamic characteristics of the projectile. The rings 26 disturb the normal airflow pattern thereby, reducing drag and increasing stability. Consequently, a player has more control over the flight of the projectile at higher speeds. Thus, the degree of the player's skill will play a greater part in determining his score.

Figure 2:
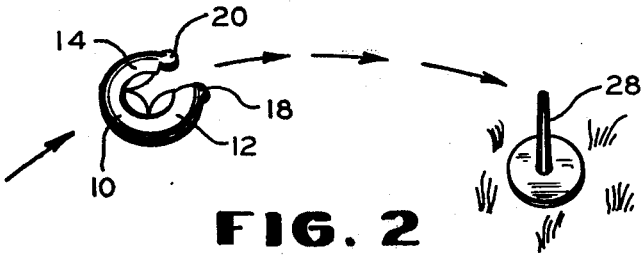
FIG. 2 is a top plan view of the game employing the projectile illustrated in FIG. 1 in flight towards an associated stake.

FIG. 2 illustrates how the projectile is used in a game. A player stands at a predetermined distance from the stake 28 from which he thrusts the projectile in such a manner as to have the cut out portion 16 ring or encircle the stake 28 that functions as a target for the projectile. A player throws the projectile towards a scoring stake 28 that may be weighted or anchored into the ground for stability.

In order to throw the projectile, a player typically grips the projectile by placing his thumb on the convex side of the saucer shaped projectile at the grasping areas 18 and 20 and one or more of his fingers on the concave side of the saucer shaped projectile at the grasping areas 18 and 20. The player stands at approximately right angles to the stake 28 and releases the projectile with a snap of the wrist. Momentum and spinning action is imparted to the projectile causing it to move toward the target. Flight direction is determined by the angle of the projectile to the ground as well as the player's skill.

It has been found that satisfactory results have been obtained by fabricating the projectile from a plastic material, such as polyethylene or polypropylene, for example.

The illustrations and descriptions of the preferred embodiment of the invention are not intended as limitations. Various modifications and changes may be incorporated without departing from the scope of the appended claims.

What I claim is:

1. A game comprising a disc projectile having a generally convex upper surface and a generally concave lower surface, said projectile having a periphery defining a circular edge extending through an arc segment greater than 180°, said periphery having a notch formed therein, said circular periphery segment and said notch defining between them a main body portion and two spaced apart leg portions, said notch having a radially inward extent greater than the radius of said projectile, and a scoring stake as a target for said projectile.

2. The invention as defined in claim 1 wherein said spaced apart leg portions of the projectile terminate in grasping areas.

3. The invention as defined in claim 2 wherein said grasping areas are generally circular in shape.

4. The invention as defined in claim 3 wherein said grasping areas are flattened.

5. The invention as defined in claim 4 wherein said grasping areas include means for preventing slippage.

6. The invention as defined in claim 5 wherein said means for preventing slippage include raised rings defining said grasping eas.

* * * * *